US009863705B2

(12) United States Patent
Cerea

(10) Patent No.: US 9,863,705 B2
(45) Date of Patent: Jan. 9, 2018

(54) PROCESS FOR DRYING FINELY DIVIDED ORGANIC SUBSTANCES CAPABLE OF PRODUCING EXPLOSIVES REACTIONS

(75) Inventor: Giuseppina Cerea, Rozzano (IT)

(73) Assignee: Vomm Chemipharma S.r.l., Rozzano (Milan) (IT)

( * ) Notice: Subject to any disclaimer, the term of this patent is extended or adjusted under 35 U.S.C. 154(b) by 1513 days.

(21) Appl. No.: 10/547,839

(22) PCT Filed: Mar. 5, 2004

(86) PCT No.: PCT/EP2004/002297
§ 371 (c)(1),
(2), (4) Date: Nov. 20, 2006

(87) PCT Pub. No.: WO2004/079282
PCT Pub. Date: Sep. 16, 2004

(65) Prior Publication Data

US 2007/0068033 A1 Mar. 29, 2007

(30) Foreign Application Priority Data

Mar. 6, 2003 (IT) ..... MI2003A0417

(51) Int. Cl.
*F26B 21/04* (2006.01)
*F26B 25/00* (2006.01)
*F26B 17/20* (2006.01)

(52) U.S. Cl.
CPC ..... *F26B 25/009* (2013.01); *F26B 17/20* (2013.01); *F26B 21/04* (2013.01)

(58) Field of Classification Search
CPC ..... F26B 25/009; F26B 17/20; F26B 21/04
(Continued)

(56) References Cited

U.S. PATENT DOCUMENTS 1,560,950 A 11/1925 Thiele
2,628,077 A 2/1953 Handwerk
(Continued)

FOREIGN PATENT DOCUMENTS

EP 0 340 966 A1 11/1989
EP 0 491 247 A1 6/1992
(Continued)

*Primary Examiner* — Jessica Yuen
(74) *Attorney, Agent, or Firm* — Silvia Salvadori, P.C.; Silvia Salvadori

(57) ABSTRACT

A continuous process and a system for drying solid organic substances in an aqueous phase or a mixed (water/organic solvent) phase, which includes feeding a continuous stream of such substances into a continuous drier, to obtain a continuous output stream of dried powder material and steam at a temperature in excess of 100° C. for delivery to an apparatus separating the powder material from the steam. A continuous run of the powder material and a continuous run of steam are discharged from the apparatus for recirculation to the drier, with the steam pressure inside the drier and the separating apparatus kept constant at a value to ensure that substantially no oxygen is present, or that the powder material cannot be ignited. The recirculation is carried out by continuous drawing, downstream of the separating apparatus, an amount of steam corresponding to the amount of steam generated within the drier.

10 Claims, 2 Drawing Sheets

(58) Field of Classification Search
USPC ..... 34/321, 443, 292, 368, 552, 134, 179, 34/180, 181, 185, 315, 320, 324, 326, 34/327, 330, 349, 418, 568, 569, 77, 79
See application file for complete search history.

(56) References Cited

U.S. PATENT DOCUMENTS

| | | | | | |
|---|---|---|---|---|---|
| 4,302,888 | A | * | 12/1981 | Boldt | 34/552 |
| 4,514,912 | A | | 5/1985 | Janusch et al. | |
| 4,834,874 | A | | 5/1989 | Anthoney et al. | |
| 4,930,571 | A | | 6/1990 | Paull | |
| 5,209,821 | A | * | 5/1993 | Shaw et al. | 159/4.01 |
| 5,255,446 | A | * | 10/1993 | Vezzani | 34/479 |
| 5,263,266 | A | * | 11/1993 | Schmidt | 34/478 |
| 5,426,866 | A | | 6/1995 | Rumocki | |
| 5,635,122 | A | * | 6/1997 | Vezzani | 264/115 |
| 5,906,793 | A | * | 5/1999 | Vezzani | 422/1 |
| 2003/0122003 | A1 | | 7/2003 | Schlesiger et al. | |
| 2004/0112796 | A1 | | 6/2004 | Stummer et al. | |

FOREIGN PATENT DOCUMENTS

| | | | | | |
|---|---|---|---|---|---|
| EP | 0 749 772 | A1 | | 12/1996 | |
| EP | 0 940 172 | A1 | * | 9/1999 | B01J 19/00 |
| FR | 2524129 | A | | 9/1983 | |
| GB | 663 862 | A | | 12/1951 | |
| GB | 1 494 487 | A | | 12/1977 | |
| GB | 2 135 034 | A | | 8/1984 | |
| WO | WO 03/052336 | A1 | | 6/2003 | |

* cited by examiner

PROCESS FOR DRYING FINELY DIVIDED ORGANIC SUBSTANCES CAPABLE OF PRODUCING EXPLOSIVES REACTIONS

BACKGROUND OF THE INVENTION

Field of Application

The present invention broadly relates to a process for drying organic substances in aqueous phases or wet organic substances in emulsified organic and aqueous phases.

In particular, the invention relates to a process as above, whereby organic substances are dried under suitable conditions to prevent the finely divided organic powders that issue from the drying process from initiating explosive reactions.

Current processes for drying slurries and the like aqueous-phase or mixed-phase dispersions of organic substances provide for heating in an inert atmosphere, usually a nitrogen atmosphere, as a precaution against explosion hazard.

An example of such a process is disclosed in patent EP 0 491 247. It is stated in this reference that the steam issuing from conventional drying processes is not sufficient to put a drying system completely out of danger. As a matter of fact, the steam cannot always ensure that the oxygen concentration is below the exploding point, because suction effects downstream of the system or air leakage may cause the instant proportion of steam contained in the system to drop significantly. For explosion prevention, the patent teaches neutralizing the system by means of an inert gas.

SUMMARY OF THE INVENTION

Although achieving its objective, such a solution to the problem dilates the system running costs due to the high cost of inert gases.

Thus, the underlying problem of this invention is to provide a process for drying organic substances in an aqueous-phase or a mixed-phase (water/organic solvent), which can remove all explosion hazards at a lower running cost of the drying system than that afforded by the aforementioned prior art processes.

This problem is solved, according to the invention, by a continuous process for drying solid organic substances in an aqueous phase or a mixed (water/organic solvent) phase, which process comprises the steps of:

feeding a continuous stream of said substances into a continuous drier, to obtain from said drier a continuous output stream of dried powder material and steam at a temperature in excess of 100° C.;

feeding said continuous stream of dried powder material and steam into at least one apparatus for separating the powder material from the steam;

discharging from said apparatus a continuous stream of the powder material and a continuous stream of steam for recirculation to the drier;

characterized in that the steam pressure inside said drier and said separating apparatus is kept at a constant value ensuring that substantially no oxygen is present, or that the powder material cannot be ignited, by continuous drawing downstream of said separating apparatus of an amount of steam corresponding to the amount of steam generated within said drier.

This amount of steam drawn downstream of the separating apparatus is then fed into condensing apparatus, specifically turbo-condensers and/or filled-type columns, prior to release to the atmosphere.

Suitably, at least a part of this amount of steam, before being conveyed to said condensing apparatus, is caused to flow through a heat exchanger, in order to generate heated water for plant usage and other applications such as remote space heating.

The steam flowing out of the separating apparatus for routing back to the drier is first caused to flow through a heat exchanger in order to make sure that its temperature meets the process conditions and is preferably within the range of 150° to 270° C.

Preferably, said at least one separating apparatus consists of a cyclone separator and an optional bag-type filter.

Preferably, said continuous drier consists of a turbo-drier which comprises a cylindrical tubular body being provided with a heating jacket, closed by end caps at both ends, formed with inlet and outlet openings, and with a bladed rotor mounted coaxially for rotation therein.

Preferably, said condensing apparatus is a turbo-condenser, for example as the one manufactured by VOMM Impianti e Processi S.r.l. and described in Patent EP 0 749 772.

This invention further relates to a system implementing the above process, and comprising:

a continuous drier having at least one inlet opening for said solid organic substances dispersed in an aqueous phase or in a mixed phase, and having at least one outlet opening for the powder material and the steam;

a separating apparatus consisting of a cyclone separator and/or a bag-type filter for separating the powder material from the steam;

a fan arranged to direct the steam issuing from said separating apparatus to said continuous drier;

characterized in that it comprises a means of keeping the steam at a constant pressure in the system by removing, downstream of said fan, a predetermined amount of said steam before it is taken to the continuous drier.

Advantageously, the system of the invention further comprises, placed downstream of said fan and said means of keeping the steam pressure constant, a second heat exchanger arranged to recover thermal energy from said amount of steam removed from the system.

Suitably, said continuous drier is a turbo-drier comprising a cylindrical tubular body provided with a heating jacket, closed by end caps at both ends, formed with at least one inlet opening and at least one outlet opening, and having a bladed rotor mounted coaxially for rotation therein.

A major advantage of the process and system according to the invention is that the solid organic substances contained in aqueous or mixed phases can be dried into fine powder at no fire or explosion hazard by virtue of the inertization afforded by the steam at all stages of the process and of its pressure being carefully controlled.

This is achieved without the need to inject expensive inert gases into the system.

In addition, by providing the turbo-drier as explained above, the energy balance of the inventive process can be made highly favorable.

The process of the invention is highly versatile and can be used for drying a range of solid organic substances in aqueous and/or water/solvent phases, such as sludge from processed city and industry waste, agricultural produce waste, pig or other animal breeding grounds, mycelia from antibiotic production plants, etc.

Further features and advantages of the method and system according to the invention should be apparent from the following description of embodiments thereof, given by way of example and not of limitation with reference to the accompanying drawings, in which:

DETAILED DESCRIPTION

Figure 1:
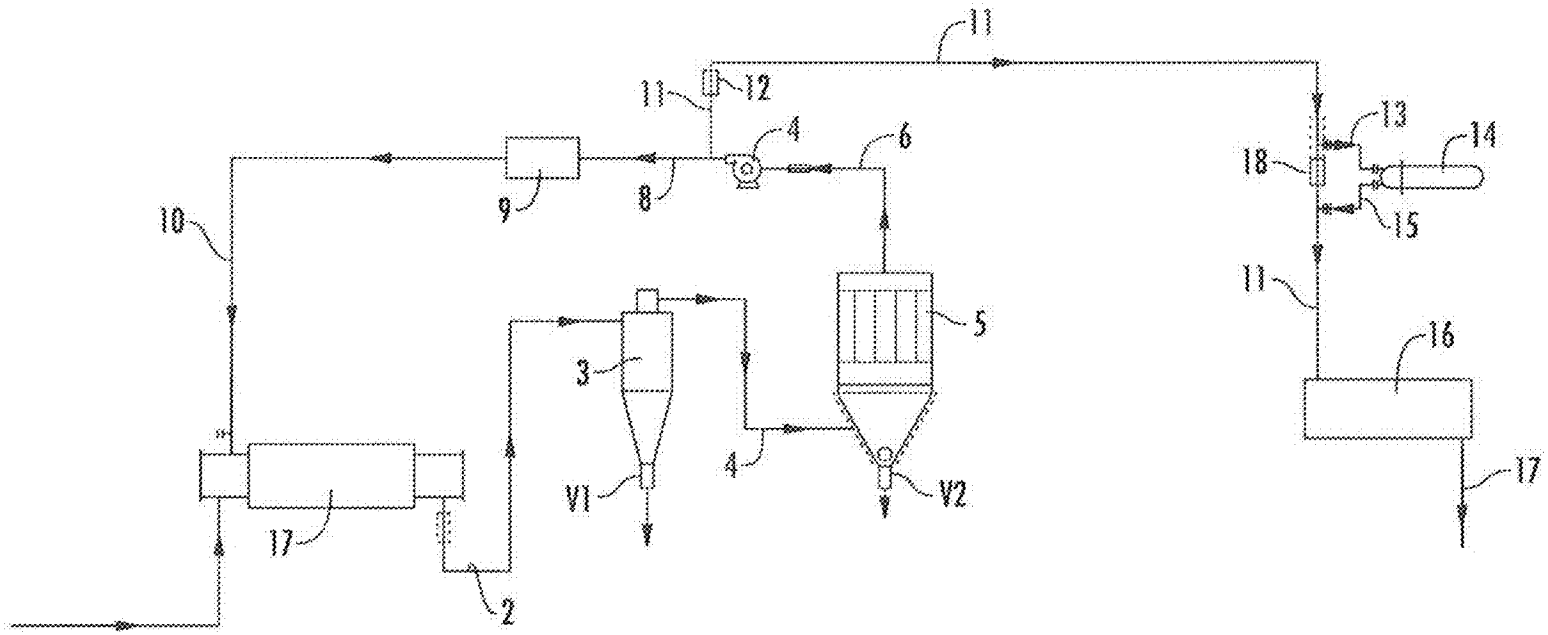
FIG. 1 is a general diagram of a system for implementing the inventive process.

With reference to FIG. 1, an exemplary system implementing the process of this invention comprises a continuous drier 1 connected to a cyclone separator 3 by a duct 2, the separator 3 being connected to a bag filter 5 by a duct 4.

A duct 6 connects the filter 5 to a fan 7, itself connected by a duct 8 to a heat exchanger 9 from which a duct 10 leads to the continuous drier 1.

A duct 11 branches off the duct 8 and includes a shut-off valve 12 connecting to a pressure transducer and control means (not shown).

Duct 11 leads to a turbo-condenser 16 whose output is connected by a duct 17 to additional gas-flow purifying apparatus.

A duct 13 branches off duct 11 and connects to the inlet of a heat exchanger 14, the latter having an outlet connected back to duct 11 by a duct 15.

A valve 18, connected to a temperature transducer and control means, is provided in the section of duct 11 that extends downstream of the branching duct 13 and upstream of the branching duct 15.

Figure 2:
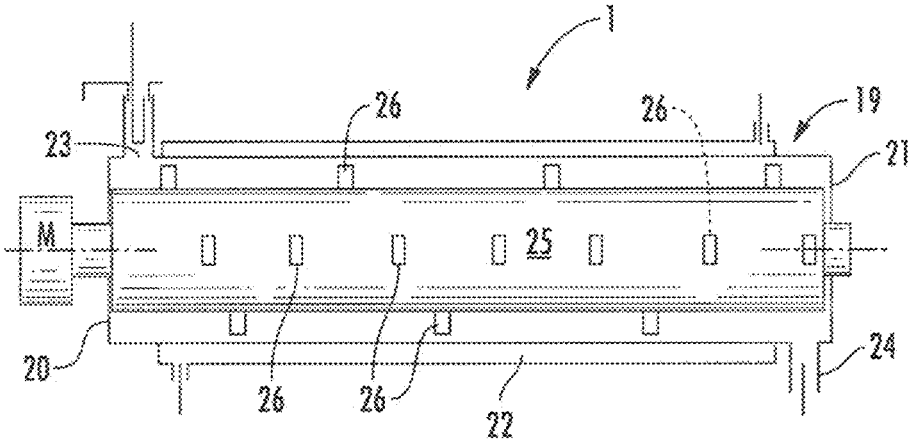
FIG. 2 shows schematically the turbo-drier employed in said system.

Shown schematically in FIG. 2 is a preferred continuous drier implementing the process of the invention.

This is an apparatus 1, which comprises basically a cylindrical tubular body 19 closed at both ends by end caps 20, 21 and provided with a coaxial heating jacket 22 through which a fluid, such as diathermic oil or steam, is caused to flow.

The tubular body 19 has an inlet opening 23 for a stream of organic substances dispersed in an aqueous phase or a mixed phase, and an outlet opening 24 for the powder material that issues from the drying process.

A bladed rotor 25 is rotatably supported within the tubular body 19. The blades 26 of this rotor are helically arranged to simultaneously centrifuge and convey to the output the material being dried. A drive motor M turns the rotor 25 at 200 to 1500 rpm, preferably at 400-600 rpm.

The turbo-drier could have more than one inlet, contingent on applicational requirements.

When a turbo-drier as described above is used, the process of this invention is carried out in the way explained here below.

A stream of organic substances of the aforementioned kind, e.g. a slurry issuing from a digester and having a moisture content of 60-80%, is continuously fed into the turbo-drier 1 through the inlet opening 23. The slurry is centrifuged by the rotor blades, from the moment it enters the turbo-drier, against the heated inner wall and simultaneously driven toward the outlet by the helical arrangement of the blades.

The water contained in the slurry, upon contacting the wall of the tubular body heated to a high temperature under the centrifuging action of the rotor blades, will evaporate at once.

Furthermore, most of the water bound to the solid particles in the slurry will be removed from the solid particles in the form of steam due to the high thermal energy transferred from the heated wall of the tubular body and the high kinetic energy imparted by the rotor blades. After a residence time that may vary between 15 and 180 seconds, a continuous stream of powder having a reduced content of moisture (approximately 10%) and steam, will be output from the turbo-drier.

This continuous stream is discharged through the discharge opening 24 and taken over duct 2 to the cyclone separator 3, where the slurry presently dried into a powder is separated from the steam. The powder is discharged through the stellar valve V1 and delivered to conventional disposal or further processing (e.g., briquetting), while the steam is dumped, via a duct 4, into the bag filter 5 where powder leftover is further separated. The last-mentioned powder is then discharged through a stellar valve V2 for the same end treatment as the powder from the cyclone.

The steam is drawn by the fan 7 into duct 6 and conveyed, through duct 8, to the heat exchanger 9, where its temperature brought to the process conditions (between 150° and 270° C.) prior to delivery to the turbo-drier 1 through duct 10.

A portion of the steam outflowing from the fan 7 is diverted to duct 11 by actuation of the valve 12 and regulated by a pressure transducer and control means to ensure that the same steam pressure is maintained throughout the system. In practice, the valve 12 is used for drawing, from a circuit including ducts 2, 4, 6, 8 and 10 and the apparatus interposed among them, an amount of steam per unit time which equals the amount of steam per unit time generated within the turbo-drier.

The amount of steam drawn from said circuit is then taken to a turbo-condenser 16 over duct 11, and over duct 17 to optional apparatus (not shown) for additional purification before release to the atmosphere.

This portion of steam is also used for energy recovery through a heat exchanger 14 for producing heated water, as. The steam flow is cut off at a given height level of duct 11 by a valve 18 and over branch duct 13 directed to the heat exchanger 14, from which it flows out through duct 15 and then through duct 11 located downstream of the valve 18.

The flow rate of the slurry or other solid organic substance in an aqueous phase or mixed phase at the turbo-drier inlet is generally in the range of 15 to 2500 kg/h, according to the capacity of the system.

The wall temperature is maintained preferably at approximately 150° to 280° C., and the average residence time of the slurry or dispersed solid organic substance within the turbo-drier will vary generally between 15 seconds and 3 minutes.

EXAMPLE

Using the apparatus described here above, operated in accordance with the process of the invention, a slurry issuing from a digester of a sewage processing system with a moisture content of about 70% was fed continuously into the turbo-drier 1 at a rate of 2000 kg/h.

The temperature of the inner wall of the cylindrical tubular body 19 was maintained at approximately 160° C. by steam circulation through the heating jacket 22, the rotational speed of the bladed rotor 25 being kept constant at 350 rpm.

Following a 180-second average residence time within the turbo-drier T, a stream of powder material and steam was discharged continuously and passed to the cyclone separator 3, whereinto most of the powder material (having a moisture content of about 7%) was dumped through the valve V1, whilst the steam and a minor fraction of the powder material entrained in the steam flow were discharged through duct 4 to the bag filter 5. Therein, residual powder material was separated from the steam, with the powder material being discharged through the valve V2 and the steam released through duct 6.

The steam drawn in by the fan was directed for the greater part to the heat exchanger 9, where it was heated to a temperature of about 200° C. before return to the turbo-drier 1.

A portion of the steam flowing out from the fan 7, corresponding to the amount of steam generated within the turbo-drier 1 per unit time, was directed over duct 11, under control of the valve 12 and suitable means of pressure control and regulation, to flow through the heat exchanger 14 and into the turbo-condenser 16.

The invention claimed is:

1. A continuous process for drying solid organic substances in an aqueous phase or a mixed water and organic solvent phase, comprising the steps of:

feeding a continuous stream of said substances having a moisture content of 60-80% into a continuous turbo-drier, which comprises a cylindrical tubular body provided with a heating jacket, closed by end caps at both ends, formed with inlet and outlet openings, and provided with a bladed rotor mounted coaxially for rotation therein, at a speed of 200 to 1500 rpm to obtain from said turbo-drier a continuous output stream of dried powder material having a moisture content of approximately 10%, and steam at a temperature within the range of 150° to 270° C.;

feeding said continuous stream of dried powder material and steam into at least one apparatus for separating the powder material from the steam; and discharging from said apparatus a continuous stream of the powder material and a continuous stream of steam, wherein said steam is fed again into the turbo-drier;

wherein the steam pressure inside the turbo-drier and said separating apparatus is kept constant and to such a value to ensure that substantially no oxygen is present by means of keeping the steam at a constant pressure comprising a valve connected to a pressure transducer, such that the powder material cannot be ignited, said means of keeping the steam at a constant pressure continuously drawing, downstream of said separating apparatus, an amount of steam corresponding to the amount of steam generated within said turbo-drier.

2. The process according to claim 1, wherein said amount of steam drawn downstream of the separating apparatus is then fed into condensing apparatus prior to release to the atmosphere.

3. The process according to claim 2, wherein at least part of said amount of steam drawn downstream of the separating apparatus before being conveyed to said condensing apparatus, is caused to flow through a heat exchanger in order to generate heated water.

4. The process according to claim 1, wherein the steam flowing out of the separating apparatus to be fed again into the turbo-drier is previously caused to flow through a heat exchanger in order to make sure that its temperature is within the range of 150° to 270° C.

5. The process according to claim 1, wherein said at least one separating apparatus is selected from the group consisting of a cyclone separator or a bag-type filter or combinations thereof.

6. The process according to claim 2, wherein said condensing apparatus is selected from the group consisting of turbo-condenser or filled-type columns, or a combination thereof.

7. A system for drying solid organic substances in an aqueous phase or a mixed water and organic solvent phase comprising:

a continuous turbo-drier comprising a cylindrical tubular body provided with a heating jacket, closed by end caps at both ends, having at least one inlet opening for said solid organic substances in an aqueous phase or a mixed phase, and having at least one outlet opening for an outlet stream of dried powder material and steam, and having a bladed rotor mounted coaxially for rotation therein, and capable of drying the solid organic substances from a moisture content of 60-80% to approximately 10%;

a separating apparatus for separating the powder material from the steam; and a fan arranged to direct an amount of steam issuing from said separating apparatus to be recirculated to said continuous turbo-drier;

wherein said system also comprises means of keeping the steam inside said turbo-drier and said separating apparatus at a constant pressure and to such a value to ensure that substantially no oxygen is present in the system, said means continuously drawing, downstream of said separating apparatus, an amount of steam equal to the amount of steam generated within said turbo-drier before it is recirculated to the continuous turbo-drier so that the powder material cannot be ignited, wherein said means of keeping the steam at a constant pressure comprises a valve connected to a pressure transducer.

8. The system according to claim 7, further comprising a heat exchanger placed between said fan and said continuous turbo-drier to heat the steam before it is fed back into said continuous turbo-drier.

9. The system according to claim 8, further comprising, placed downstream of said fan and said means of keeping the steam pressure constant, a second heat exchanger arranged to recover thermal energy from said amount of steam removed from the system.

10. The system according to claim 7, wherein said separating apparatus is selected from the group consisting of a cyclone separator or a bag-type filter, or a combination thereof.

* * * * *